United States Patent [19]

Araki et al.

[11] 4,422,064

[45] Dec. 20, 1983

[54] ELECTRICAL RESISTANCE REGULATOR

[75] Inventors: Toshio Araki, Yokohama; Kenji Fujikawa, Kawasaki, both of Japan

[73] Assignee: Canon Kabushiki Kaisha, Tokyo, Japan

[21] Appl. No.: 299,090

[22] Filed: Sep. 3, 1981

[30] Foreign Application Priority Data

Sep. 10, 1980 [JP] Japan ..... 55-128689[U]

[51] Int. Cl.[3] ..... H01C 10/32

[52] U.S. Cl. ..... 338/162; 338/167

[58] Field of Search ..... 338/160, 162–164, 338/167, 172, 179, 184, 183, 190, 191, 198, 135

[56] References Cited

U.S. PATENT DOCUMENTS 3,428,887 2/1969 Miller ..... 338/135 X

*Primary Examiner*—C. L. Albritton

*Attorney, Agent, or Firm*—Fitzpatrick, Cella, Harper & Scinto

[57] ABSTRACT

A regulator is provided which includes a housing, a seesaw-like operating member supported by the housing, a projection provided on the operating member, two movable members rotatably supported by the housing to push back the projection in a predetermined direction, a spring secured to these movable members to bias them in opposite directions, and limit member provided on the housing to determine the approach limit amount of the two movable members, a resistor provided on the housing, and a sliding brush coupled to the operating member to slide on the resistor.

16 Claims, 9 Drawing Figures

ELECTRICAL RESISTANCE REGULATOR

BACKGROUND OF THE INVENTION

1. Field of the Invention

This invention relates to a device for selecting a desired voltage, and particularly to a variable resistor provided with a seesaw-like operating piece.

2. Description of the Prior Art

It has become common that a zoom lens is incorporated in a television or motion picture camera, and zooming adjustment is accomplished manually or electrically. In the case of electrical zooming, it is necessary to effect designation of the zooming direction, i.e., whether the angle of view is to be rendered wide or telephoto, and designation of the zooming speed. For this reason, a seesaw switch is usually used. In particular the zooming direction is determined by which end edge of the switch seesaw piece is pushed and the zooming speed is determined by the amount of the push-in of the piece. The zoom ring of the lens barrel is connected to a motor which is controlled by the output of a potentiometer (a variable resistor regulated by rotating its shaft) which in turn is regulated by the seesaw switch. The conventional seesaw switch is provided with a seesaw piece rockable relative to a rotary shaft and a spring for maintaining the seesaw piece neutral. Further, a semigear meshing with a gear for rotating the shaft of the potentiometer is formed in a portion of the seesaw piece. Accordingly, when one end of the seesaw piece is pushed in, the semigear causes the shaft of the potentiometer to be rotated through the association of the semigear and the gear.

Back-lash occurs to the gear train and therefore, the movement of the seesaw piece does not smoothly correspond to the movement of the potentiometer. As a result, accurate control becomes impossible and the effect during operation is bad. While, on the other hand, the adjustment for alleviating the back-lash during the assembly step requires time and labor.

SUMMARY OF THE INVENTION

It is an object of the present invention to make the movement of the operating piece accurately correspond to the setting of an electrical resistance value.

It is another object of the present invention to design the operating piece such that it can be smoothly pushed in and pushed back.

It is still another object of the present invention to make the device compact.

It is yet still another object of the present invention to make the assembly during the process of manufacture easy.

The invention will become fully apparent from the following detailed description thereof taken in conjunction with the accompanying drawings.

DESCRIPTION OF THE PREFERRED EMBODIMENTS

Figure 1:
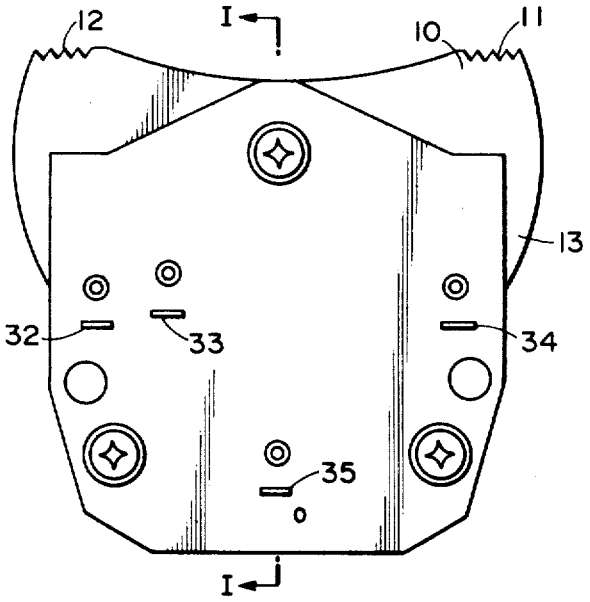
FIG. 1 is a pictorial front view of an embodiment of the present invention.

Referring to FIG. 1, reference numeral 10 designates a seesaw piece. Reference numerals 11 and 12 denote the push-in portions thereof which are formed with grooves suitable for being engaged by fingers. Designated by 13 is a semicircular plate of the seesaw piece 10 and a portion thereof is provided with a shaft hole 14 and a pillar-like projection 15 as shown in FIG. 2.

Denoted by reference numeral 20 is a first fixed plate. One side surface thereof is formed with a rotary shaft 22 which is rotatably fitted in the shaft hole 14 of the seesaw piece. Below the rotary shaft 22, there is formed a pillar-like projection 23 whose diameter is equal to the diameter of the projection 15. Further, below the pillar-like projection 23, there is provided a spring shaft 24 on which are fitted the coiled portion of a spring 25 and holes of pincer pieces 26 and 27.

Figure 3:
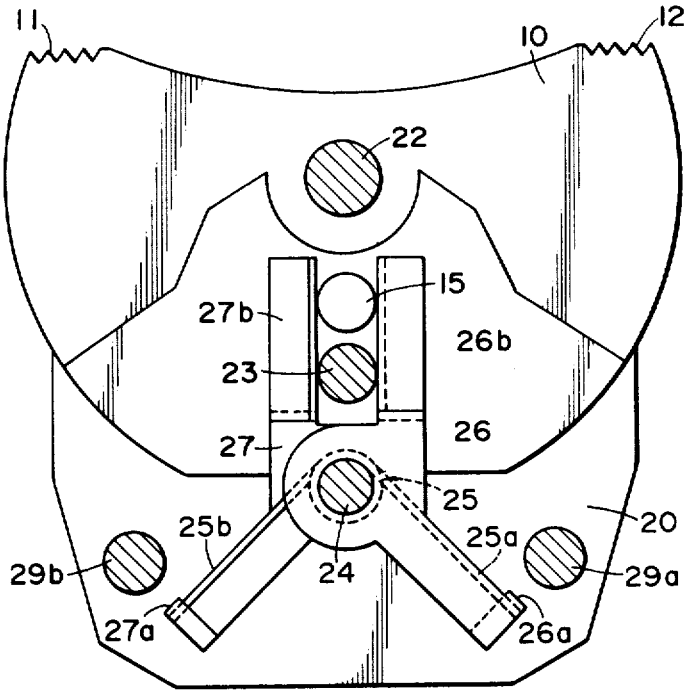
FIG. 3 is a cross-sectional view taken along plane II—II of FIG. 2.

The relation between the spring 25 and the pincer pieces 26, 27 is as depicted in FIG. 3 wherein the engaging ends 26*a* and 27*a* of the pincer pieces are engaged with the straight portions 25*a* and 25*b*, respectively, of the spring, so that the engaging end 26*a* is biased counter-clockwise while the engaging end 27*a* is biased clockwise. As a result, the control ends 26*b* and 27*b* of the pincer pieces bear against the side surfaces of the projection 23 of the fixed plate to control the position of the projection 15 of the seesaw piece, so that the seesaw piece is maintained in its neutral condition except if any extraneous force is applied thereto.

Figure 2:
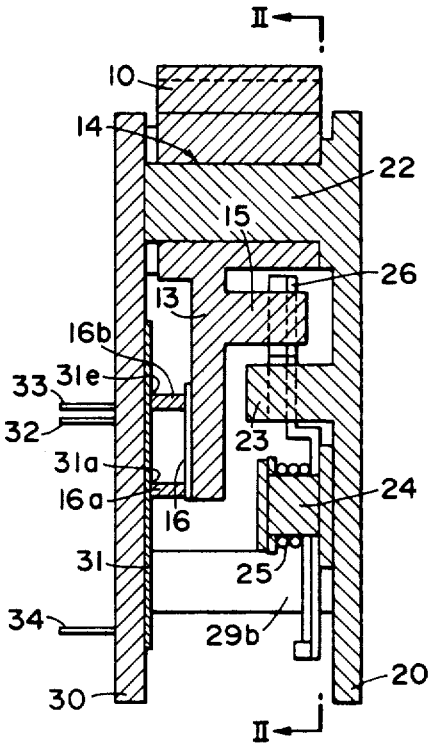
FIG. 2 is a cross-sectional view taken along plane I—I of FIG. 1.
Figure 4:
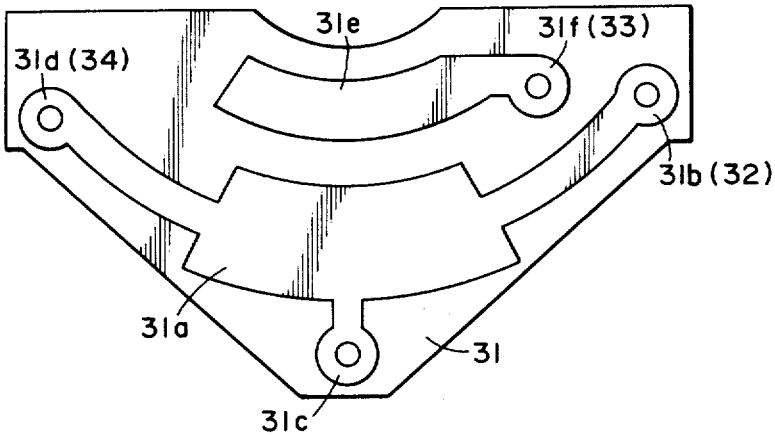
FIG. 4 is a plan view of a resistor.

Reference numeral 30 in FIG. 2 designates a second fixed plate which is fixed to the first fixed plate 20 through the shaft 22 and struts 29*a* and 29*b*. A resistance unit 31 is secured to the inner surface of the second fixed plate 30. A plan view thereof is as shown in FIG. 4 wherein there is provided a sector-like electrical resistor 31*a*, terminals 31*b* and 31*d* connected to the ends of the resistor, and a terminal 31*c* connected to the center of the resistor. There is further provided a sector-like conductor 31*e* and a terminal 31*f*. These terminals 31*b*–31*d* and 31*f* are, respectively, connected to terminals 32–35 disposed outside the fixed portion. On the other hand, a brush 16 adapted to slide while being in contact with the resistor 31*a* and conductor 31*e*, is fixed to the seesaw piece 13. The brush 16, as shown in the plan view of FIG. 5A and the side view of FIG. 5B, is provided with two mutually electrically conducting brush pieces 16*a* and 16*b*, with the piece 16*a* being contact with the resistor 31*a* and with the piece 16*b* being in contact with the conductor 31*e*.

Alternatively, the resistor may be disposed on the operating means while the sliding means or brush 16 is disposed on the housing, i.e., the resistor may be disposed either on the housing or on the operating means while the sliding member is disposed on the other.

Operation will hereinafter be described. When, for example, the push-in portion 11 of the seesaw piece 10 is pushed in, the seesaw piece is rotated about the shaft 22 and at that time, the projection 15 pushes the control end 26*b* (FIG. 3) of the pincer piece rightward as viewed in the figure and therefore, the spring end 25*a* receives the force in roll-in direction and stores a resilient force therein.

When the seesaw piece 10 is rotated, brushes 28*a* and 28*b* slide on the resistor 31*a* and conductor 31*e* and in this case, the brushes move toward an end 31*d*. Accordingly, if a predetermined voltage is applied between ends 31*b* and 31*d*, a voltage corresponding to the push-in of the seesaw piece can be found out, and the push-in direction is reflected in whether such a voltage is large or small relative to the output of the central end, and the amount of push-in is reflected in the difference output.

Figure 6:
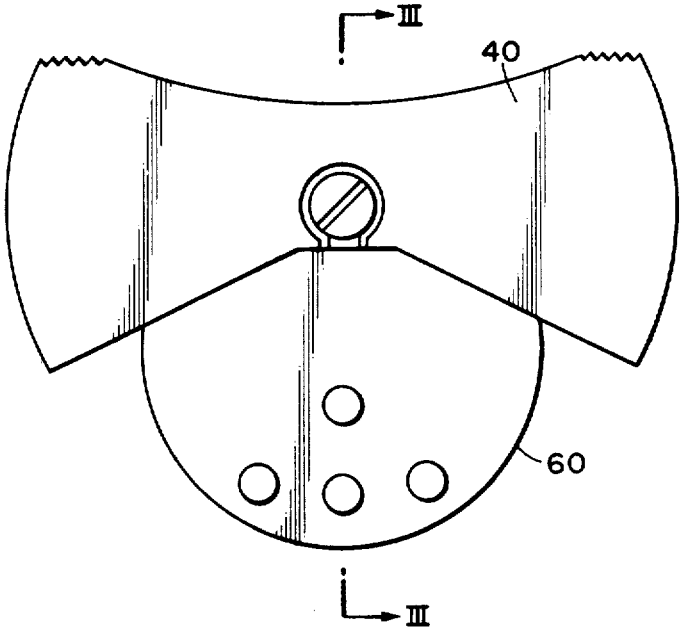
FIG. 6 is a pictorial front view of another embodiment of the present invention.
Figure 7:
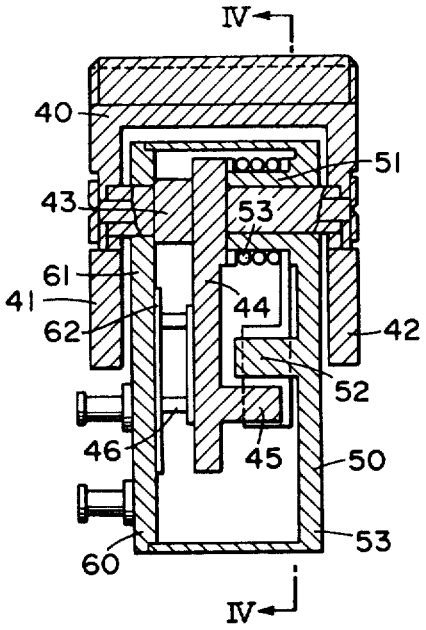
FIG. 7 is a cross-sectional view taken along plane III—III of FIG. 6.
Figure 8:
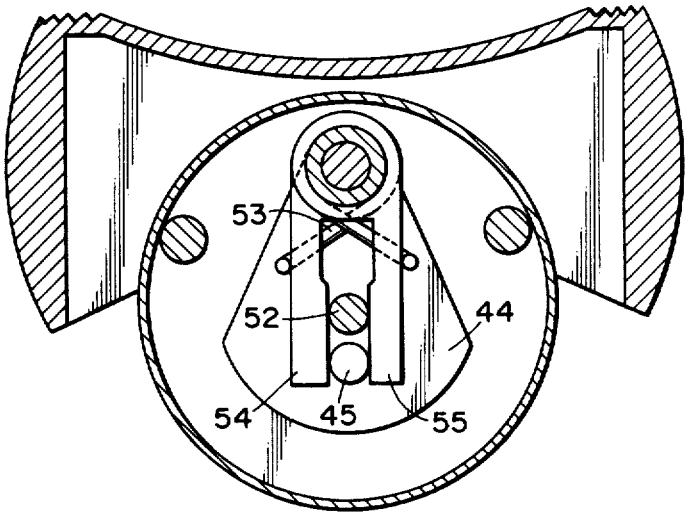
FIG. 8 is a cross-sectional view taken along plane IV—IV of FIG. 7.

FIGS. 6, 7 and 8 show another embodiment of the present invention. This embodiment is characterized in that the portion contained in the casing is made into an air-tight construction, and it is useful for dust-proof and humidity-proof purposes.

Reference numeral 40 designate a seesaw piece and in this example, it is in such a form that a casing formed by a fixed plate 60 or the like comes into the inside of side plates 41 and 42. Designated by 43 is a rotary shaft secured to the side plates 41 and 42 of the seesaw piece, and a rockable plate 44 is fixed to the rotary shaft 43. The rockable plate 44 is formed with a pillar-like projection 45, and a brush 46 is fixed to the back side thereof.

Reference numeral 50 denotes a box-like casing having a bearing 51 formed in a side surface thereof, and the rotary shaft 43 is fitted in the shaft hole. The outer periphery of the bearing 51 provides a holding shaft on which is fitted the coiled portion of a spring. Designated by 52 is a pillar-like projection formed on the side surface of the casing and having a diameter equal to that of the projection 45. Designated by 60 is a fixed plate engaged with the opening side of the casing 50 to render the casing air-tight. The fixed plate 60 is formed with a shaft hole for the rotary shaft 43, and a resistance unit 62 is fixed to the inner surface of the fixed plate.

Reference numerals 54 and 55 in FIG. 8 denote pincer pieces and a portion thereof is formed with a shaft hole which is rotatably fitted over the outer periphery of the bearing 51. A spring 53 is secured to these pincer pieces, so that the two pincer pieces are strongly forced against the projection 52 to control the position of the projection 52 on the rockable plate.

Figure 5A:
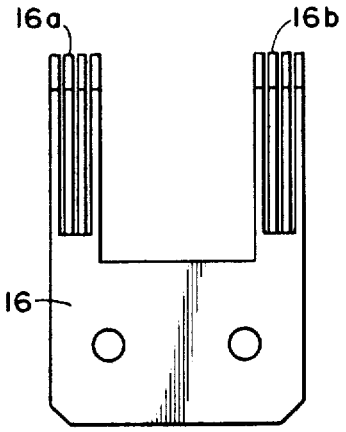
FIGS. 5A and 5B are a front view and a side view, respectively, of a brush.
Figure 5B:
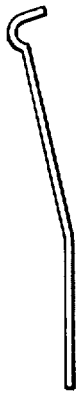

Again in this embodiment, the construction of the resistance unit 62 and brush 46 is similar to that depicted in FIGS. 4, 5A and 5B.

In the above-described construction, when one end of the seesaw piece 4 is pushed, the rotary shaft 43 is rotated and the projection 45 moves against the resilient force of the pincer piece 54 or 55 and the rockable plate 44 moves, so that the brush 46 slides on the resistor of the resistance unit and the conductor. When the finger is released from the seesaw piece, the projection 52 is forced back by the force of the spring 53 and, when the pincer pieces are forced against the projection 45 and are stopped thereby, the rockable plate becomes stationary at its neutral position.

The above-described present invention eliminates the inconvenience resulting from the back-lash of gears and its compactness is very convenient for the device to be incorporated into an apparatus. Moreover, the reduced number of parts leads to inexpensive manufacturing of the device.

What we claim is:

1. A regulator comprising:

a housing;

an operating member having a central portion which is rotatably supported on said housing;

a projection provided on said operating member;

two movable members rotatably supported on said housing to push back said projection in a predetermined direction;

a spring secured to said movable members to bias them in opposite directions;

a limit member provided on said housing to limit the approach limit amount of said movable members;

an electrical resistor provided on said housing; and a sliding member provided on said operating member and slidable on said electrical resistor.

2. A regulator according to claim 1, wherein the diameter of said projection is equal to the diameter of said limit member.

3. A regulator according to claim 1, wherein said electrical resistor has two insulated sub-resistors and said sliding member has two sub-sliding members electrically coupled together.

4. A regulator according to claim 1, wherein said operating member and said movable members are supported by a same shaft.

5. A regulator comprising:

a housing;

seesaw-like operating means supported by said housing;

engaging element provided on said operating means;

two pressurizing members pivotably supported on said housing for pressuring said engaging means in opposite directions;

resilient means for supplying pressurization force to said pressurizing members;

control means for controlling the approach limit of said two pressurizing members;

an electrical resistor disposed on said housing and having a sliding surface; and a sliding member disposed on said operating means and slidable on the sliding surface.

6. A regulator according to claim 5, further comprising a conductor disposed in juxtaposition to said electrical resistor, said sliding member adapted to electrically connect said conductor with said electrical resistor.

7. A regulator according to claim 6, wherein said electrical resistor includes a central portion connected to a terminal and opposite end portions each connected to a separate terminal.

8. A regulator according to claim 5, wherein said engaging element is a pillar-like projection.

9. A regulator according to claim 5, wherein the width of said engaging element is equal to the approach limit by said control means.

10. A regulator according to claim 5, wherein said electrical resistor is fixed to said housing.

11. A regulator comprising:

a housing;

seesaw-like operating means supported by said housing;

engaging element provided on said operating means;

two pressurizing members pivotably supported on said housing for pressurizing said engaging means into opposite directions;

resilient means for supplying pressurization force to said pressurizing members;

control means for controlling the approach limit of said two pressurizing members;

an electrical resistor disposed on said operating means and having a sliding surface; and a sliding member disposed on said housing and slidable on the sliding surface.

12. A regulator according to claim 11, further comprising a conductor disposed in juxtaposition to said electrical resistor, said sliding member adapted to electrically connect said conductor with said electrical resistor.

13. A regulator according to claim 12, wherein said electrical resistor includes a central portion connected to a terminal and opposite end portions each connected to a separate terminal.

14. A regulator according to claim 11, wherein said engaging element is a pillar-like projection.

15. A regulator according to claim 11, wherein the width of said engaging element is equal to the approach limit by said control means.

16. A regulator according to claim 11, wherein said electrical resistor is fixed to said housing.

* * * * *